United States Patent [19]

Saginoya

[11] 4,172,358

[45] Oct. 30, 1979

[54] HIGH ACCURACY TIMER ACTUATING MECHANISM IN A LEAF TYPE DIGITAL CLOCK

[75] Inventor: Masashi Saginoya, Tokyo, Japan

[73] Assignee: Copal Company Limited, Tokyo, Japan

[21] Appl. No.: 849,469

[22] Filed: Nov. 7, 1977

[30] Foreign Application Priority Data

Nov. 10, 1976 [JP] Japan ..... 51-150021[U]

[51] Int. Cl.[2] ..... G04C 21/16; G04C 23/10

[52] U.S. Cl. ..... 58/7; 58/9; 58/38 R

[58] Field of Search ..... 58/7, 8, 9, 16 P, 38 R, 58/38 A, 125 R, 125 C

[56] References Cited

U.S. PATENT DOCUMENTS

| | | | |
|---|---|---|---|
| 3,708,973 | 1/1973 | Funaki | 58/125 C |
| 3,807,165 | 4/1974 | Kawada | 58/125 C |
| 3,830,053 | 8/1974 | Koide | 58/125 C |
| 3,952,177 | 4/1976 | Murata et al. | 58/38 R |

*Primary Examiner*—Gene Z. Rubinson

*Attorney, Agent, or Firm*—Oblon, Fisher, Spivak, McClelland & Maier

[57] ABSTRACT

A high accuracy timer actuating mechanism in a leaf type digital clock having a timer, a manually actuatable timer setting drum and a rotating clutch cam cooperating therewith so as to actuate a clutch lever at a set time manually set in the timer setting drum so that a switch for actuating the timer is closed by the actuation of the clutch lever. The clutch lever is provided with an arresting lug which is releasably arrested by an ON-OFF lever so that, when the clutch lever is arrested by the ON-OFF lever, the switch is held opened so as to render the timer to be inoperative. An actuating lever cooperates with the ON-OFF lever and is actuated by a plurality of cam projections of an actuating cam rotated together with the minute indicating drum so as to release the ON-OFF lever from the clutch lever thereby permitting the same to be actuated by the clutch cam. Thus, the switch can be closed only when the ON-OFF lever is released from the clutch lever by the actuation of the actuating cam during the time the clutch cam is actuated by the timer setting drum. This insures the actuation of the timer at a far more accurate time as set in the timer setting drum than the actuation solely by the clutch cam without the provision of the ON-OFF lever, because the clutch lever can be actuated only when it is released from the ON-OFF lever actuated in relation to the minute indicating drum in the order of minutes.

5 Claims, 2 Drawing Figures

HIGH ACCURACY TIMER ACTUATING MECHANISM IN A LEAF TYPE DIGITAL CLOCK

BACKGROUND OF THE INVENTION

1. Field of the Invention

The present invention relates to a high accuracy timer actuating mechanism in a leaf type digital clock having a timer.

2. Description of the Prior Art

Heretofore, a leaf type ditital clock having a timer was well known in which a clutch lever is provided which cooperates with a clutch cam adapted to be actuated by a manually actuatable timer setting drum at a set time manually set in the timer setting drum so that the clutch lever is actuated by the actuation of the clutch cam so as to close a switch for actuating the timer.

In such a type of the digital clock, however, since the switch is closed by the actuation of the clutch lever when a projecting cam portion of the clutch cam is engaged within a recessed portion of the timer setting drum as the clutch cam rotates so that the clutch cam is permitted to move axially to actuate the clutch lever, the accuracy in time at which the projecting cam portion of the clutch cam will fall into the recessed portion of the timer setting drum at the set time so as to close the switch for actuating the timer is rather low such as in the order of 10 minutes, because the clutch cam is rotated at so low speed as that of the hour indicating drum rotating one revolution per 24 hours.

The present invention aims at improving the accuracy in time of the actuation of the timer in a leaf type digital clock.

SUMMARY OF THE INVENTION

An object of the present invention is to provide a novel and useful high accuracy timer actuating mechanism in a leaf type digital clock having a timer which avoids the deficiencies in the prior art clock and has a superior accuracy in time for actuating the timer.

Another object is to provide a high accuracy timer actuating mechanism in a leaf type digital clock having a timer of the type described above which insures the accuracy in time in the order of one minute by virtue of utilization of the minute indicating drum rotated at a higher speed such as a rotational speed of one revolution per an hour for limiting the time of actuation of the clutch lever.

The above objects are achieved in accordance with the present invention by the provision of a high accuracy timer actuating mechanism characterized by an arresting lug formed in the clutch lever, an OFF-OFF lever biased so as to be releasably engaged with the arresting lug for arresting the clutch lever in a position to maintain the switch in its opened state while the clutch lever is permitted to either open or close the switch when the ON-OFF lever is released from the arresting lug of the clutch lever, an actuating lever engaged with the ON-OFF lever for causing the ON-OFF lever to release the arresting lug of the clutch lever when the actuating lever is actuated, and an actuating cam rotated in relation to the rotation of the minute indicating drum and engaging with the actuating lever so as to actuate the ON-OFF lever as the cam rotates thereby permitting the switch to be closed only when the actuating lever is actuated by the actuating cam during the time the clutch lever is in a position to be actuated by the actuation of the clutch cam.

By virtue of the above described construction of the timer actuating mechanism of the present invention, the time at which the switch is closed by the actuation of the clutch cam is limited only to the time during which the ON-OFF lever is releasing the clutch lever by the actuation of the actuating lever actuated by the actuating cam rotated in relation to the rotation of the minute indicating drum.

A plurality of projections may be provided on the actuating cam while the actuating cam is rotated together with the minute indicating drum so that the ON-OFF lever releases the clutch lever a plurality of times per an hour thereby insuring the closure of the switch accurately at the set timer time. Alternatively, the actuating cam may be rotated a plurality of revolutions per one revolution of the minute indicating drum for achieving the same result as above.

In accordance with a further feature of the present invention, a manually actuatable knob member may be provided which is engageable with the clutch lever so that the clutch lever is held inoperable to maintain the switch in opened state regardless of the setting of the timer setting drum.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
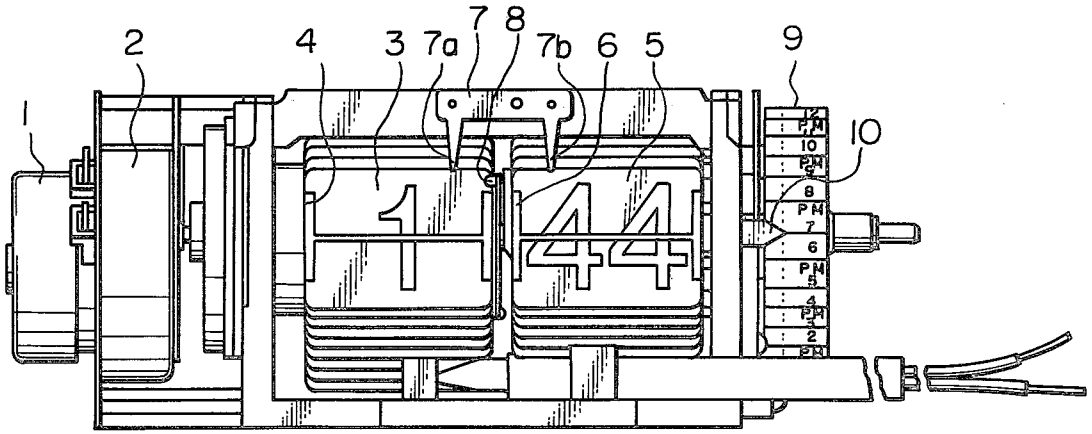
FIG. 1 is a front elevational view showing an example of the leaf type digital clock in which the present invention is incorporated.

Referring to FIG. 1, the leaf type digital clock includes an electric motor 1 and a reduction gear 2 driven by the motor 1 and driving a shaft (not shown) which in turn rotates through a further reduction gear (not shown) an hour indicating drum 4 provided with a plurality of hour indicating leaves 3 arranged around the periphery of the drum 4 at a speed of one revolution per 24 hours so that respective succeeding leaf 3 is turned over one by one when it is disengaged from an arresting finger 7*a* of a stopper plate 7 as the drum 4 is rotated thereby indicating the time in terms of the hour. In like manner the shaft drives a minute indicating drum 6 having a plurality of minute indicating leaves 5 around the periphery thereof at a speed of one revolution per hour so that the time is indicated in terms of the minute by the succeeding leaves 5 successively turned over when they are disengaged one by one from an arresting finger 7*b* of the stopper plate 7 as the drum 6 rotates.

In order to synchronize the switching of the hour indicating leaf 3 with the switching of the last one of the minute indicating leaves 5 at the end of each hour, a synchronizing mechanism 8 of a well known type is interposed between the hour indicating leaves 3 and the minute indicating leaves 5.

A manually operable timer setting drum 9 is provided which has provided on the periphery thereof time graduations for setting the time at which the timer is to be actuated. An index 10 is provided cooperating with the time graduations in the timer setting drum 9 for facilitating the manual setting of the timer actuating time.

Figure 2:
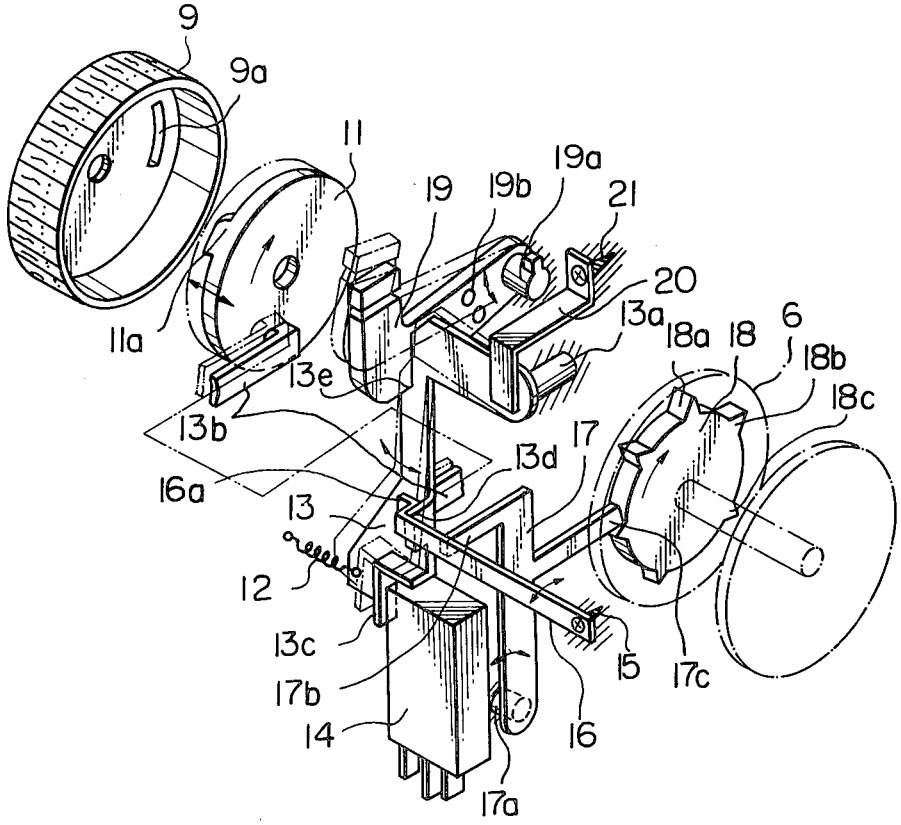
FIG. 2 is an exploded perspective view showing the main portions of an embodiment of the high accuracy timer actuating mechanism of the present invention.

As shown in FIG. 2, the timer setting drum 9 is formed with an engaging portion, i.e., a recessed portion 9*a*. An axially shiftable clutch cam 11 adapted to be rotated together with the hour indicating drum 4, i.e., at a speed of one revolution per 24 hours, is arranged coaxial with the timer setting drum 9 and is formed with a mating engaging portion, i.e., a projecting cam portion 11*a* adjacent to be fitted into the recessed portion 9*a* of the timer setting drum 9 as the clutch cam 11 rotates so that the latter is allowed to be shifted axially toward the drum 9 and, as the cam 11 rotates further, the cam 11 is again shifted apart from the drum 9 when the cam portion 11*a* is disengaged from the recessed portion 9*a*.

A swingable L-shaped clutch lever 13 is pivotally supported by a pivot shaft 13*a* integral with the lever 13 and pivotally engaging with a frame (not shown) of the clock. The lever 13 is urged in the clockwise direction by a spring 12 having one end secured to the lever 13 and the other end secured to the frame and it is provided with a laterally extending arm 13*b* so that the free end of the arm 13*b* abuts against the clutch cam 11 so that the latter is urged toward the drum 9 for permitting the cam 11 to be moved axially toward the drum 9 as shown by the chain line when the cam portion 11*a* engages within the recessed portion 9*a* as the cam 11 rotates.

The clutch lever 13 is further provided with a bent portion 13*c* cooperating with a switch 14 connected to a warning device or a radio or the like so that the switch 14 is held opened to render the warning device or the radio or the like to be inoperative when the lever 13 is swung in the counterclockwise direction as shown by the solid line, i.e., when the clutch cam 11 is held apart from the timer setting drum 9 as shown by the solid line by virtue of the disengagement of the cam portion 11*a* from the recessed portion 9*a*, while the switch 14 is closed to actuate the warning device or the radio or the like when the clutch cam 11 is moved toward the timer setting drum 9 as shown by the chain line by the engagement of the cam portion 11*a* within the recessed portion 9*a* at the set time during the rotation of the cam 11 so as to allow the clutch lever 13 to be swung in the clockwise direction as shown by the chain line by the action of the spring 12.

An L-shaped stopper 20 is secured to the frame by a set screw 21 serves to prevent the pivot shaft 13*a* of the clutch lever 13 from being withdrawn from the frame.

In accordance with the characteristic feature of the present invention, the clutch lever 13 is provided with an arresting bent lug 13*d* which is releasably engageable with a bent portion 16*a* formed at the free end of an ON-OFF lever 16 made of a resilient material and secured to the frame at the other end by a set screw 15. Thus, when the arresting lug 13*d* is engaged with the bent portion 16*a* of the ON-OFF lever 16, the clutch lever 13 is held at a position to maintain the switch 14 in the opened state by the bent portion 13*c* of the lever 13, whereas, when the arresting lug 13*d* is disengaged from the bent portion 16*a* of the ON-OFF lever 16 by the deflection thereof, the clutch lever 13 is permitted to be swung in the clockwise direction by the action of the spring 12 when the clutch cam 11 is moved axially toward the timer setting drum 9 at the set time set therein by the engagement of the projecting cam portion 11*a* with the recessed portion 9*a* thereby closing the switch 14 to actuate the warning device or the radio or the like.

In order to release the ON-OFF lever 16 from the clutch lever 13 accurately in time at the set time, an actuating lever 17 is provided. The lever 17 is pivotally supported to the frame of the clock by a pivot shaft 17*a* integral with the lever 17 and has a bent projecting lug 17*b* adapted to engage with the ON-OFF lever 16 so as to disengage the ON-OFF lever 16 from the clutch lever 13 when the actuating lever 16 is swung in the counterclockwise direction and a further bent projecting lug 17*c* as shown in FIG. 2.

An actuating cam 18 is integrally secured to the minute indicating drum 6 so as to be rotated together therewith at a speed of one revolution per an hour. The cam 18 is provided with a plurality of equally spaced projecting cam portions 18*a*, 18*b*, 18*c*—(six cam portions being provided in the illustrated embodiment) around the periphery of the cam 18 which are adapted to successively engage with the bent projecting lug 17*c* of the actuating lever 17 as the cam 18 rotates, so that the actuating lever 17 is swung in the counterclockwise direction each time one of the projecting cam portions 18*a*, 18*b*,—engages with the bent projecting lug 17*c* thereby releasing the ON-OFF lever 16 from the clutch lever 13.

The position of the respective cam portions 18*a*, 18*b*—is preferably set in relation to the minute indicating drum 6 so that the actuating lever 17 is actuated each time the time indication by the drum 6 reaches a convenient round number such as 00 min., 10 min., 20 min.—etc.

The number of the projecting cam portions 18*a*, 18*b*,—may be varied to any desired number.

Similarly, the recessed portion 9*a* of the timer setting drum 9 may be replaced by a projecting portion together with the replacement of projecting cam portion 11*a* of the clutch cam 11 by a mating recessed portion in order to achieve the same result as described above.

In operation, the timer setting drum 9 is manually set to a desired timer time. Then, the clutch cam 11 is rotated together with the hour indicating drum 4, and, when the cam portion 11*a* of the cam 11 engages with the recessed portion 9*a* of the drum 9, the cam 11 is permitted to be shifted axially toward the drum 9, but, if the arresting lug 13*d* of the clutch lever 13 is still arrested by the bent portion 16*a* of the ON-OFF lever 16 due to the fact that any one of the projecting cam portions 18*a*, 18*b*, - - - does not yet engage with the projecting lug 17*c* of the actuating lever 17, the switch 14 is held opened. And, when the lug 13*d* is disengaged from the ON-OFF lever 16 by the actuation of the lever 17 by the engagement of the lug 17*c* with one of the cam portions 18*a*, 18*b*,—of the cam 18, the clutch lever 13 is first permitted to be swung in the clockwise direction by the action of the spring 12 to close the switch 14 for the operation of the warning device or the radio or the like, because the cam 11 is in the position at which it is permitted to be axially shifted as described above. When the cam portion 11*a* is disengaged from the recessed portion 9*a* as the cam 11 rotates, the cam 11 is axially shifted apart from the drum 9 to swing the clutch lever 13 in the counterclockwise direction against the action of the spring 12 so that the switch 14 is again opened to stop the actuation of the warning device or the radio or the like while the bent portion 16*a* of the ON-OFF lever 16 is again engaged with the arresting lug 13*d* of the clutch lever 13 so as to maintain the lever 13 at the position at which the switch 14 is held opened.

The clutch lever 13 will continue to be held at the position at which the switch 14 is held opened even though the ON-OFF lever 16 is released from the clutch lever 13 by the actuation of the actuating lever 17 caused by the cam portions 18*a*, 18*b*, - - - of the actuating cam 18 unless the set time is reached so that the clutch cam 11 is allowed to be axially shifted toward the timer setting drum 9.

It is clear that the above construction permits the time of actuation of the timer at the set time to be made extremely accurate, because the time of actuation of the actuating lever 17 is very accurate because of the high rotating speed of the cam 18 and the provisions of a plurality of cam projections 18*a*, 18*b*, - - - on the cam 18 achieving the accuracy in time in the order of one minute in comparison with the accuracy in time of actuation of the timer solely by means of the clutch arm 11 cooperating with the timer setting drum 9 which would only be able to achieve the accuracy in time in the order of 10 minutes.

The plurality of the cam projections 18*a*, 18*b*, - - - formed on the cam 18 rotated together with the minute indicating drum 6 may be replaced by a cam having at least one cam projection but rotated at a rotational speed higher than that of the minute indicating drum 6 by an integral numberof times such as the rotational speed of six revolutions per an hour in order to achieve the same result as described above.

In the present invention, a manually actuatable knob member 19 may be provided in order to render the timer to be inoperative. The member 19 is pivotally supported on the frame by a pivot shaft 19*a*, and the member 19 is swung between two positions and snugly held at the respective positions by clicking recesses 19*b* cooperating with a clicking ball (not shown). In one position of the member 19 as shown by chain line in FIG. 2, the member 19 is disengaged from the clutch lever 13 so that the lever 13 can be freely actuated as described previously. However, when the member 19 is moved to the other position as shown by the solid line, the lower edge of the member 19 engages with the inclined shoulder portion 13*e* of the clutch lever 13 so as to urge the lever 13 in the counterclockwise direction to maintain the switch 14 in the opened state thereby rendering the warning device or the radio or the like to be inoperative regardless of the actuations of the clutch cam 11 and the actuating lever 17.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A high accuracy timer actuating mechanism in a leaf type digital clock of the type which includes a rotatable hour indicating drum and a rotatable minute indicating drum rotating at a speed higher than that of said hour indicating drum, said timer actuating mechanism comprising:

a manually settable timer setting drum;

a clutch cam rotated together with said hour indicating drum and engageable with said timer setting drum;

a clutch lever cooperating with said clutch cam and adapted to be actuated by the engagement of said clutch cam and said timer setting drum;

a switch connected to said timer for actuating said timer when said switch is closed, the closing of said switch being accomplished by the actuation of said clutch lever;

an arresting lug formed in said clutch lever;

an ON-OFF lever biased into releasable engagement with said arresting lug and adapted to maintain said cluch lever in an unactuated position when so engaged;

an actuating lever engaged with said ON-OFF lever, said actuating lever adapted to be engageable with said ON-OFF lever to release said engagement of said ON-OFF lever and said arresting lug; and an actuating cam rotated together with said minute indicating drum and engaging with said actuating lever to engage said actuating lever with said ON-OFF lever as said actuating cam rotates.

2. Mechanism according to claim 1, wherein said timer setting drum is formed with an engaging portion while said clutch cam is provided with a mating engaging portion adapted to be engaged with said engaging portion of said timer setting drum during the rotation of said clutch cam, and said clutch lever is biased by spring means against said clutch cam so as to urge said clutch cam against said timer setting drum thereby permitting said clutch cam to be actuated when said mating engaging portion thereof engages with said engaging portion of said timer setting drum.

3. Mechanism according to claim 1, wherein said ON-OFF lever is formed of a resilient leaf member tending to engage with said arresting lug by its resilient force and said actuating lever is interposed between said ON-OFF lever and said actuating cam so that said ON-OFF lever is urged so as to be released from said arresting lug to free said clutch lever when said actuating lever is actuated by said actuating cam.

4. Mechanism according to claim 1, wherein said actuating cam is provided with a plurality of projecting cam portions engaged with said ON-OFF lever as said actuating cam rotates so that said ON-OFF lever is actuated by said projecting cam portions a plurality of times per hour at predetermined time intervals as said actuating cam rotates.

5. Mechanism according to claim 1, including a manually actuatable knob member engageable with said clutch lever so as to arrest said clutch lever in a position when said knob member engages with said clutch lever wherein said switch is held opened to render said timer to be inoperative.

* * * * *